United States Patent [19]

Patin et al.

[11] Patent Number: 5,001,493

[45] Date of Patent: Mar. 19, 1991

[54] MULTIBAND GRIDDED FOCAL PLANE ARRAY ANTENNA

[75] Inventors: Robert J. Patin, Hawthorne; Mon N. Wong, Torrance; Donald C. D. Chang, Thousand Oaks, all of Calif.

[73] Assignee: Hughes Aircraft Company, Los Angeles, Calif.

[21] Appl. No.: 352,435

[22] Filed: May 16, 1989

[51] Int. Cl.[5] ..... H01Q 1/38; H01Q 20/06

[52] U.S. Cl. ..... 343/700 MS; 343/846

[58] Field of Search ..... 343/700 MS, 829, 846, 343/853, 909, 767, 769, 770

[56] References Cited

U.S. PATENT DOCUMENTS

| | | | |
|---|---|---|---|
| 4,074,270 | 2/1978 | Kaloi | 343/700 MS |
| 4,772,890 | 9/1988 | Bowen et al. | 343/700 MS |
| 4,809,008 | 2/1989 | Gunton | 343/700 MS |

*Primary Examiner*—Michael C. Wimer

*Attorney, Agent, or Firm*—Robert A. Westerlund; Steven M. Mitchell; Wanda K. Denson-Low

[57] ABSTRACT

A multiband gridded focal plane array antenna 10 is disclosed which provides simultaneous beams of multiple frequencies. The antenna 10 includes a metallization pattern 11 providing a first set of conductive edges 18 having a first length $L_1$ and a second set of conductive edges 20 having a second length $L_2$. The first and second sets of conductive edges are separately fed to provide the first and second simultaneous output beams at first and second operating frequencies.

9 Claims, 5 Drawing Sheets

FIG. 2(a)
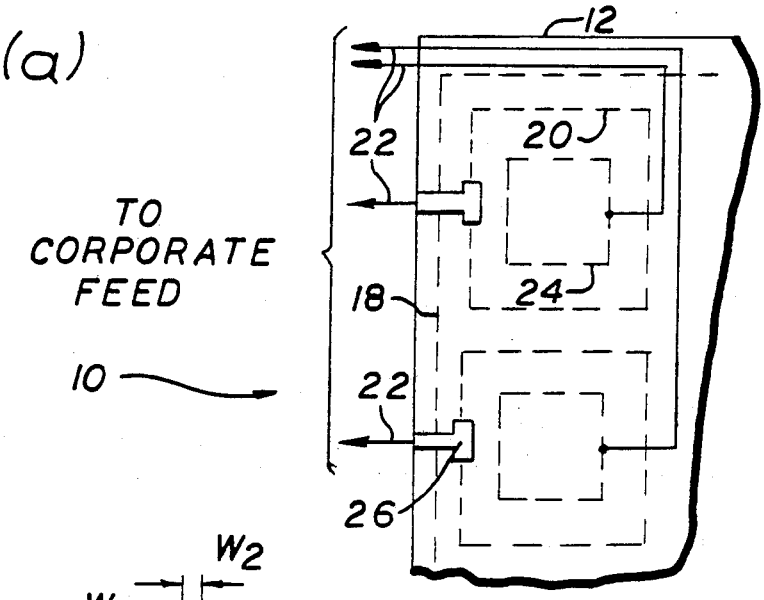
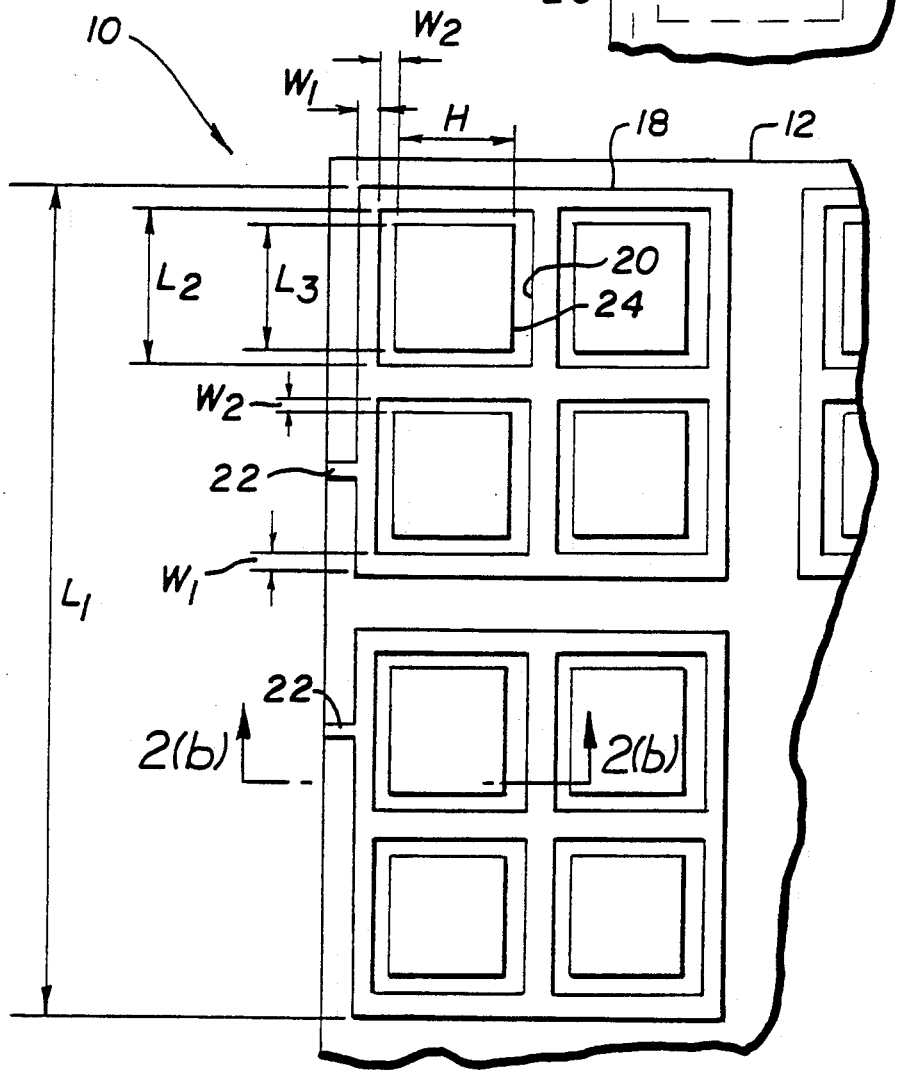
FIG. 2(c)

MULTIBAND GRIDDED FOCAL PLANE ARRAY ANTENNA

BACKGROUND OF THE INVENTION

1. Field of the Invention:

The present invention relates to antennas. More specifically, the present invention relates to multiband focal plane array antennas.

While the invention is described herein with reference to a particular embodiment for an illustrative application, it is understood that the invention is not limited thereto. Those having ordinary skill in the art and access to the teaching provided herein will recognize additional modifications, applications and embodiments within the scope thereof.

2. Description of the Related Art:

Focal plane array antennas include an array of radiating elements which may be individually excited to provide an electrically steered beam. Microstrip patch antenna arrays provide a focal plane array antenna of lightweight construction which is particularly useful for spacecraft applications.

Typically, microstrip patch array antennas operate at a single frequency. Accordingly, multiple frequency operation may require multiple arrays, each operating within a separate portion of a frequency spectrum. If one or more low frequencies are required this may be particularly problematic due to the size and weight requirements of conventional patch array antennas. Accordingly, the heretofore common practice of using several conventional array antennas for multi-frequency operation has necessitated large, unwieldy, heavy, costly antenna configurations.

Thus, there is a need in the art for a compact, lightweight, multi-frequency array antenna.

SUMMARY OF THE INVENTION

The need in the art is substantially addressed by the multiband gridded focal plane array antenna of the present invention. The present invention provides a compact, lightweight multi-frequency array antenna which provides simultaneous beams of multiple frequencies. The antenna of the invention includes a metallization pattern providing a first plurality of conductive edges of a first length $L_1$ and a second plurality of conductive edges of a second length $L_2$. The first and second sets of conductive edges are separately fed to provide first and second simultaneous output beams at first and second operating frequencies.

In the illustrative embodiment, the first plurality of conductive edges are connected to provide outer edges of a grid. The second plurality of conductive edges are connected to provide inner edges of the grid. The inner edges define apertures in the grid within which a third plurality of conductive edges of a third length $L_3$ are disposed. The third plurality of conductive edges are the outer edges of solid patches. In an alternative embodiment, a fourth and fifth plurality of conductive edges of fourth and fifth lengths $L_4$ and $L_5$ respectively, are disposed within the apertures in conjunction with the third plurality of conductive edges. The fourth and fifth conductive edges are the outer edges of solid patches.

BRIEF DESCRIPTION OF THE DRAWINGS

FIG. 1(*b*) shows a perspective view of the rear surface of the multiband gridded focal plane array antenna constructed in accordance with the teachings of the present invention.

FIG. 2(*b*) is a cross-sectional perspective view taken along the line AA of FIG. 2(*a*).

FIG. 2(*c*) shows a magnified fragmentary front view of the multiband gridded focal plane array antenna constructed in accordance with the teachings of the present invention.

DESCRIPTION OF THE INVENTION

Figure 1A:
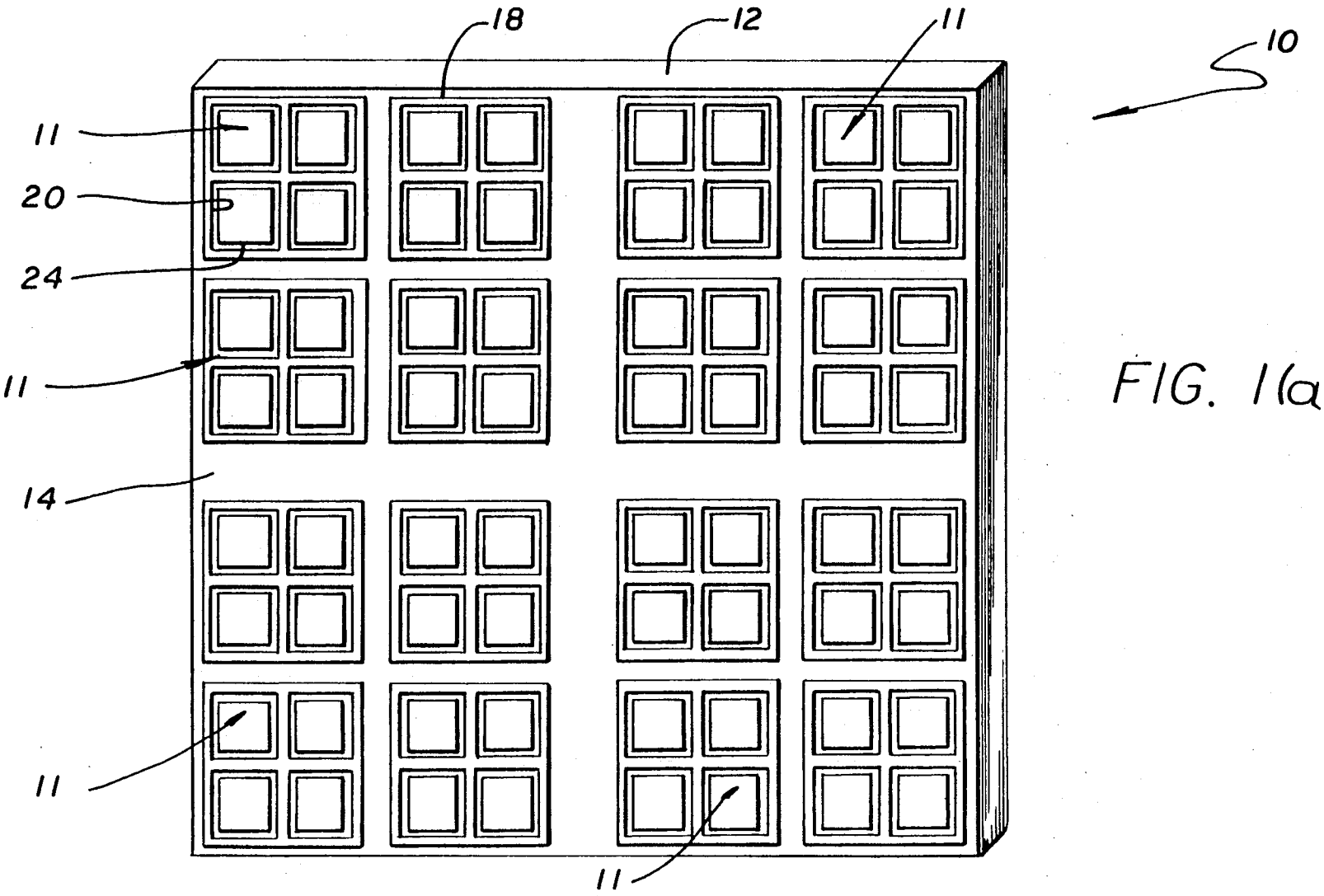
FIG. 1(*a*) shows a perspective view of the front surface of a multiband gridded focal plane array antenna constructed in accordance with the teachings of the present invention.
Figure 1B:
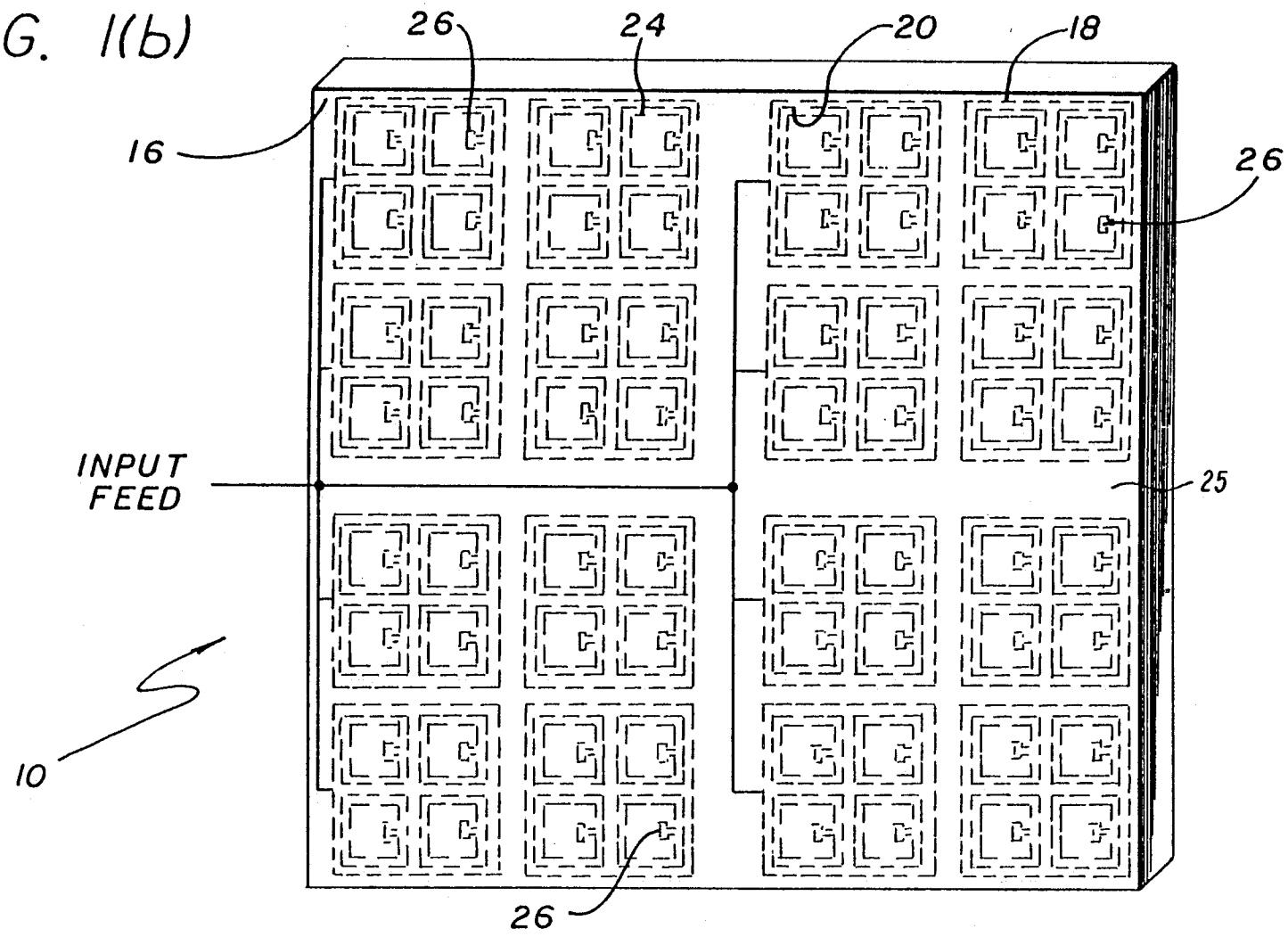

FIG. 1(*a*) shows a perspective view of the front surface of a multiband gridded focal plane array antenna 10 constructed in accordance with the teachings of the present invention. The antenna 10 includes a metallization pattern 11 disposed on a dielectric board 12. The metallization pattern 11 is disposed on the front surface 14 of the dielectric board 12 which provides an array or grid of radiating elements. A first set of radiating elements is provided by a plurality of outer edges 18 of conductive material of a first length $L_1$. A second set of radiating elements is provided by a plurality of inner edges 20 of conductive material of a second length $L_2$. In the illustrative embodiment of FIG. 1(*a*), the inner edges 20 are interconnected and provide apertures in the metallization pattern 11 within which a plurality of microstrip patches 24 are disposed. The outer edges of the microstrip patches 24 provide edges of conductive material of a third length $L_3$. Hence, the outer edges of the microstrip patches provide a third set of radiating elements.

FIG. 1(*b*) shows a perspective view of the rear surface 16 of the antenna 10 constructed in accordance with the teachings of the present invention. Plural resonators 26 are positioned on the second surface 16 of the dielectric board 12 to couple electromagnetic energy to the second radiating elements 20 (shown in phantom). As described in a copending application entitled "Focal Plane Array Antenna" filed Mar. 2, 1989 by Wong, et al., Ser. No. 317,882 electromagnetic energy is coupled from each resonator 26 to a corresponding second radiating element 20. The resonators 26 are photoetched on a ground plane 25 on the second surface 16 of the dielectric board 12 by a conventional etching process. The magnified fragmentary rear view of the antenna 10 of FIG. 2(*a*) shows the resonators 26 positioned under the second radiating elements 20. Electromagnetic energy, radiated from the resonators 26, couples through the dielectric board 12 to the second radiating elements 20 (shown in phantom). The second radiating elements 20 reradiate the energy thus received into space.

Figure 2B:
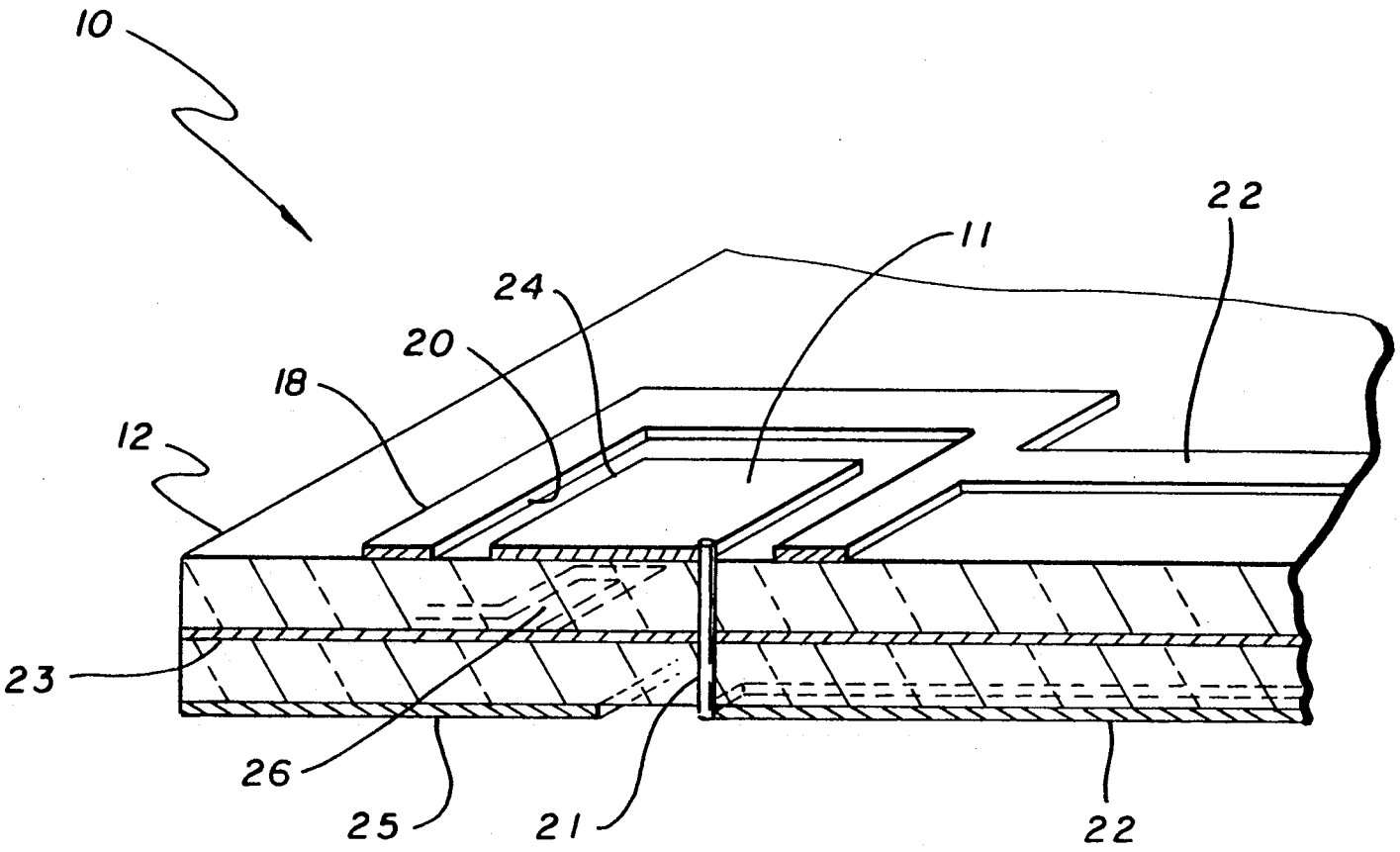
FIG. 2(*a*) shows a magnified fragmentary rear view of the multiband gridded focal plane array antenna constructed in accordance with the teachings of the present invention.

FIG. 2(*b*) is a cross-sectional perspective view taken along the line AA of FIG. 2(*a*). As shown in FIG. 2(*b*), the third radiating elements 24 are fed by pin connectors 21 which extend through the board 12 to microstrip feed lines 22 on the rear surface. Note the ground planes 23 and 25 and that the pins 21 could be replaced by a coupling slot through the ground planes 23 and 25. It should also be noted that where the frequencies of operation permit, the first, second and/or third radiating elements may also be fed electromagnetically by resonators 26 properly sized and positioned without departing from the scope of the present teachings. In the preferred embodiment, the first radiating elements are fed by microstrip feeds 22 on the front surface 14 of the board 12 and the third radiating elements 24 are fed by microstrip feeds 22 and pins 21 on the rear surface of the board 12. The feeds from the resonators 26 and from the first radiating elements 18 are connected to corporate feed networks (not shown) as is common in the art.

FIG. 2(*c*) shows a magnified fragmentary front view of the multiband gridded focal plane array antenna constructed in accordance with the teachings of the present invention. Multiband operation is afforded by the first, second and third radiating elements 18, 20 and 24 having first, second and third frequencies $f_1$, $f_2$ and $f_3$ respectively.

As is known in the art, the lengths L of the radiating elements are a function of the wavelength of the radiated energy at the desired operating frequency and the dielectric constant $\epsilon_r$ of the substrate 12 as given by equation [1] below:

$$L \approx 0.49\lambda_d = 0.49\lambda_o/(\epsilon_r)^{\frac{1}{2}} \quad [1]$$

where L = length of element
$\epsilon_r$ = relative dielectric constant
$\lambda_d$ = dielectric substrate wavelength
$\lambda_o$ = free-space wavelength In the preferred embodiment, the width $W_1$ between first and second radiating elements 18 and 20 respectively, is given by equation [2] below:

$$W_1 = 0.025\ \lambda_d \quad [2]$$

where $\lambda_d$ = dielectric substrate wavelength

The width $W_2$ between second and third radiating elements 20 and 24 respectively, is given by equation [3] below:

$$W_2 = 0.05\ H \quad [3]$$

where H = horizontal length of patches 24

In a preferred embodiment, the second radiating elements 20 have a length $L_2$ which is related to the length $L_1$ of the first radiating elements 18 by equation [4] below:

$$L_2 = L_1 - 3w_1/2 \quad [4]$$

The third radiating elements 24 have a length $L_3$ which is slightly less than the length $L_2$ of the second radiating elements 20. That is:

$$L_3 = L_2 - 2w_2 \quad [5]$$

Thus the first radiating elements lB radiate energy at a low first frequency $f_1$. The second radiating elements 20 radiate at an intermediate second frequency $f_2$ which is two and three tenths (2.3) times the first frequency $f_1$. And the third radiating elements 24 radiate at a high third frequency $f_3$ which is slightly greater than one and one tenth (1.1) times the second frequency $f_2$.

Those skilled in the art with access to the teachings of the present invention will appreciate that the first and third radiating elements 18 and 24 respectively, are in relative phase with each other, are electrically similar and provide phase characteristics similar to an inductor. The second radiating elements 20 enclose dielectric material 12 and provide phase characteristics similar to a capacitor. That is, the second radiating elements 20 operate 180 degrees out of phase with respect to the first and third radiating elements 18 and 24 respectively.

Figure 3:
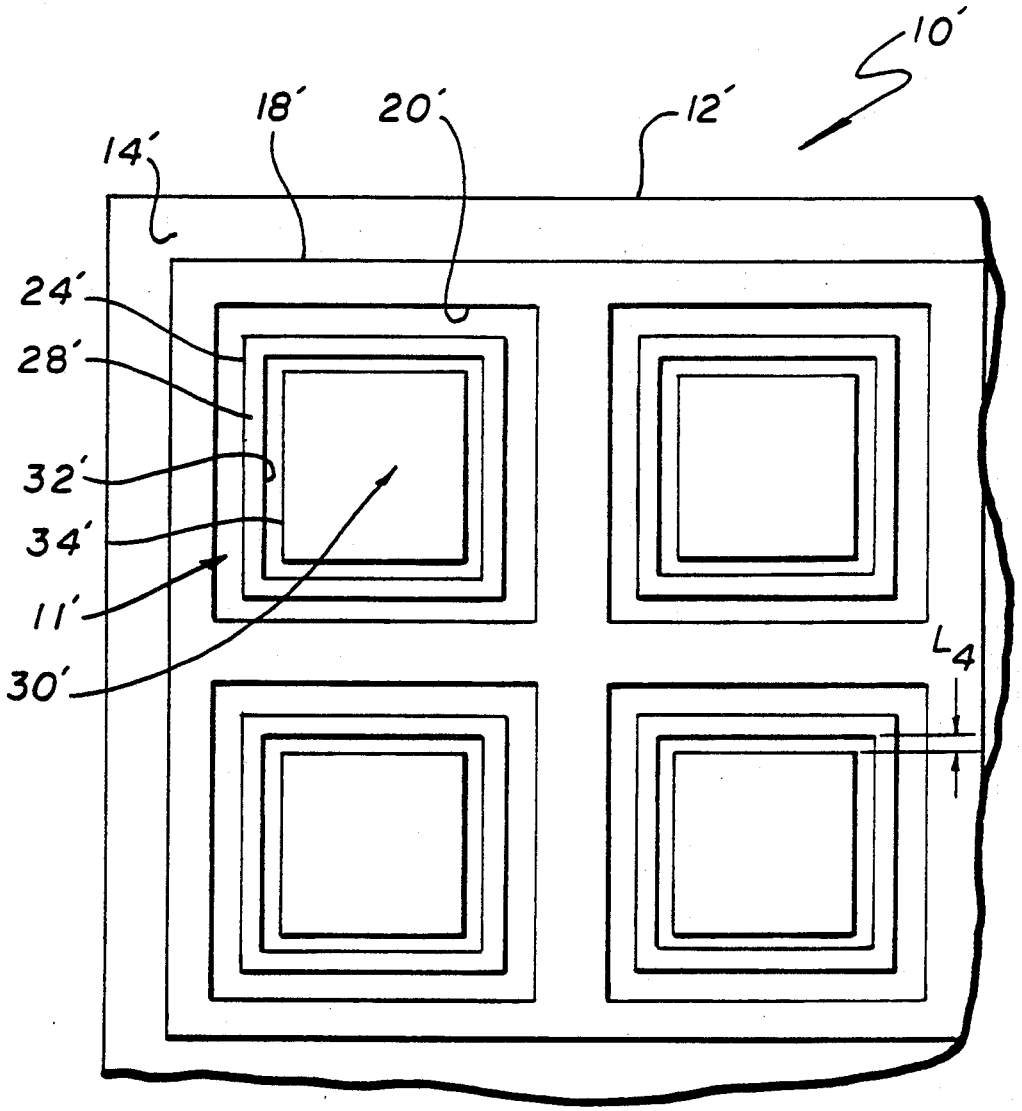
FIG. 3 shows a magnified fragmentary front view of an alternative embodiment of the multiband gridded focal plane array antenna constructed in accordance with the teachings of the present invention.

FIG. 3 shows a magnified fragmentary front view of an alternative embodiment of an antenna 10′ constructed in accordance with the teachings of the present invention. Fourth and fifth sets of radiating elements in the grid are provided by a rectangular ring 28′ and a patch 30′ respectively disposed within the metallization pattern 11′ on the front surface 14′ of the dielectric board 12′. That is, the inner edges 32′ of the ring 28′ provide fourth edges of conductive material of a fourth length $L_4$ and hence a fourth set of radiating elements. The outer edges 34′ of the patches 30′ provide fifth edges of conductive material of a fifth length $L_5$ and hence a fifth set of radiating elements. In keeping with the invention, the first, second, third, fourth and fifth radiating elements 18′, 20′, 24′, 32′ and 34′ respectively, may be photoetched on the dielectric board 12 by a conventional etching process and may be copper or any other suitably conductive material. The antenna of the alternative embodiment may be fed as described above with respect to the embodiment of FIG. 1(*a*).

Thus, a single antenna has been disclosed which provides output beams of multiple frequencies. While the present invention has been described herein with reference to an illustrative embodiment and a particular application it is understood that the invention is not limited thereto. Those having ordinary skill in the art and access to the teachings of the present invention will recognize additional modifications, applications and embodiments within the scope thereof. For example, the invention is not limited to the design of the metallization pattern of the illustrative embodiment. The patches may be of any shape e.g., rectangular, triangular, circular or etc. and may be gridded and/or perforated. Nor is the invention limited to any particular technique for feeding energy to the radiating elements. Further, the invention is not limited to a one-to-one relationship between the radiating elements and the resonators. Nor is the invention limited to any particular number of concentric radiating elements. And, by way of example, the surface of the dielectric board may be of any shape (e.g. concave) without departing from the scope of the invention.

It is therefore intended by the appended claims to cover any and all such applications, modifications and embodiments within the scope of the present invention.

Accordingly,

What is claimed is:

1. A multiband antenna, comprising:

a metallization pattern disposed on a first surface of a dielectric substrate, said metallization pattern including a first set of conductive edges having a first length, a second set of conductive edges having a second length, and a third set of conductive edges having a third length;

first means for coupling electromagnetic energy of a first operating frequency to said first set of conductive edges;

second means for coupling electromagnetic energy of a second operating frequency to said second set of conductive edges;

third means for coupling electromagnetic energy of a third operating frequency to said third set of conductive edges; and, wherein said first set of conductive edges, said second set of conductive edges, and said third set of conductive edges collectively define a grid, said first set of conductive edges providing outer edges of said grid, said second set of conductive edges providing inner edges of said grid, with said inner edges being interconnected to provide a set of inner apertures, and said third set of conductive edges being disposed within said inner apertures.

2. The antenna as set forth in claim 1, wherein said third set of conductive edges are provided by patches of conductive material.

3. The antenna as set forth in claim 2, further comprising a fourth set of conductive edges having a fourth length.

4. The antenna as set forth in claim 3, wherein said fourth set of conductive edges are disposed within said inner apertures of said grid.

5. The antenna as set forth in claim 4, wherein said fourth set of conductive edges are provided by patches of conductive material.

6. The antenna as set forth in claim 5, further comprising a fifth set of conductive edges having a fifth length.

7. The antenna as set forth in claim 6, wherein said fifth set of conductive edges are disposed within said inner apertures of said grid.

8. The antenna as set forth in claim 1, wherein said second means for coupling electromagnetic energy to said second set of conductive edges comprise resonators mounted to a second surface of said dielectric substrate.

9. The antenna as set forth in claim 8, further comprising transmission line means mounted to said dielectric substrate for directly feeding said electromagnetic energy to said resonators, said electromagnetic energy then being coupled to said second set of conductive edges.

* * * * *